United States Patent [19]

Jacobs et al.

[11] 4,162,026

[45] Jul. 24, 1979

[54] INTERLOCK MECHANISM

[75] Inventors: Philip F. Jacobs; Evelyn Friedman; Peter Southall, all of Whitehall, N.Y.

[73] Assignee: E. B. Metal & Rubber Industries, Inc., Whitehall, N.Y.

[21] Appl. No.: 806,308

[22] Filed: Jun. 13, 1977

[51] Int. Cl.[2] ..... G07F 11/02

[52] U.S. Cl. ..... 221/92; 221/130; 312/198

[58] Field of Search ..... 221/92–96, 221/123–132; 194/1 R; 312/198–200, 107.5, 215, 216, 218, 290

[56] References Cited

U.S. PATENT DOCUMENTS

| | | | |
|---|---|---|---|
| 506,756 | 10/1893 | Westphal | 312/198 |
| 772,533 | 10/1904 | Reardon | 221/93 X |
| 2,220,175 | 11/1940 | Rice | 221/130 X |
| 3,142,522 | 7/1964 | Hall et al. | 312/199 |

FOREIGN PATENT DOCUMENTS

| | | | |
|---|---|---|---|
| 15874 | of 1910 | United Kingdom | 312/218 |

*Primary Examiner*—Joseph J. Rolla

[57] ABSTRACT

The invention relates to a locking mechanism for interlocking two units, which is tamper proof and which requires locking the otherwise accessible parts of one of the units before the other can be locked, and in which locking the other unit automatically locks the one unit.

18 Claims, 3 Drawing Figures

INTERLOCK MECHANISM

BACKGROUND OF THE INVENTION

The present invention generally relates to a locking mechanism for interlocking adjacent, operatively associated units. It relates more particularly to a locking mechanism for interlocking vending units of the type disclosed in copending U.S. application Ser. No. 771,377 field by us and Cyrus A. Alldred and Frank M. Kecseti on Feb. 23, 1977, now U.S. Pat. No. 4,121,707. In the following disclosure while a locking mechanism is disclosed for interlocking vending units in superposed relation, it will be apparent that the locking mechanism can also be used for interlocking units, other than vending units, which moreover may be related in other than superposed relation.

Vending units have magazines which are stocked with items which are dispensed from the unit upon depositing within a coin slot in the unit of a predetermined coin amount. To permit access to the interior of such units to enable loading of the magazines therein, the unit is provided with access parts such as doors, closure lids and the like. After loading of the magazines the access parts are generally locked to ensure against unauthorized removal of the items to be dispensed from the unit. Generally, key operated locks serve this purpose. In the case of a satellite vending machine mounted atop a basic vending machine as disclosed in our mentioned application this would entail separate locking operations for locking the access parts of the satellite and basic vending machines. Separate locking operations entail the risk that the service attendant may lock the access parts of one of the machines but may forget to do so for the other due, for example, to distractions, interruptions or the need to attend to other pressing matters.

SUMMARY OF THE INVENTION

The invention provides a locking mechanism for interlocking two units, which is tamper proof and which requires the placing of the access parts of one of the units in locking position before the other can be locked, and in which the unit in locking position, is automatically locked incident to the locking operation of the other unit.

The locking mechanism is intended for use with first and second separate units each having accessible parts movable between open and closed position to respectively permit and prevent access to the interior of the units and comprises an elongate member supported at one of its ends in one of the units for movement between first and second positions. The elongate member has a length such that its opposite end portion extends into the other unit. Moving means are provided in the other unit operatively connected to the opposite end portion of the elongate member for moving the latter between its first and second positions. Forming part of the moving means is a manually operated element which is positioned wholly within the confines of the other unit upon moving the elongate member to one of its positions which extends exteriorly of the other unit upon moving the elongate member to its other position. By this arrangement, when the manually operated element extends exteriorly of the other unit, the access parts (doors, etc.) of the other unit cannot be closed, and thus cannot be locked, until that element is moved from its exteriorly extending to its interior confined position. As will be seen from the disclosure to follow, when the manually operated element is operated to extend exteriorily of the other unit, it simultaneously moves the elongate member to a position in which the accessible parts of the first unit may be opened and when the element is moved for confinement within the other unit it moves the elongate member to a position in which it locks the accessible parts of the first unit. It is a feature of the invention that the accessible parts of the first unit if in open position must first be closed before the manually operated element can move the elongate member to its locking position. By this arrangement it is impossible to lock the access parts of the other unit, i.e. the door of the lower basic unit before closing the access parts of the first unit, i.e. the door and top lid of the upper satellite unit. The locking mechanism is adapted to lock the door and lid when in closed position incident to closing and locking operation of the door of the lower basic unit.

BRIEF DESCRIPTION OF THE DRAWINGS

Objects and advantages of the invention will be apparent from the following disclosure taken in conjunction with the accompanying drawings, in which.

DESCRIPTION OF THE INVENTION

Although, as above noted, the locking arrangement of the invention may be used for interlocking units other than vending machines and other than in superposed relation, for purpose and ease of disclosure, the locking mechanism will be disclosed as interlocking the vending machines of our copending application.

Figure 1:
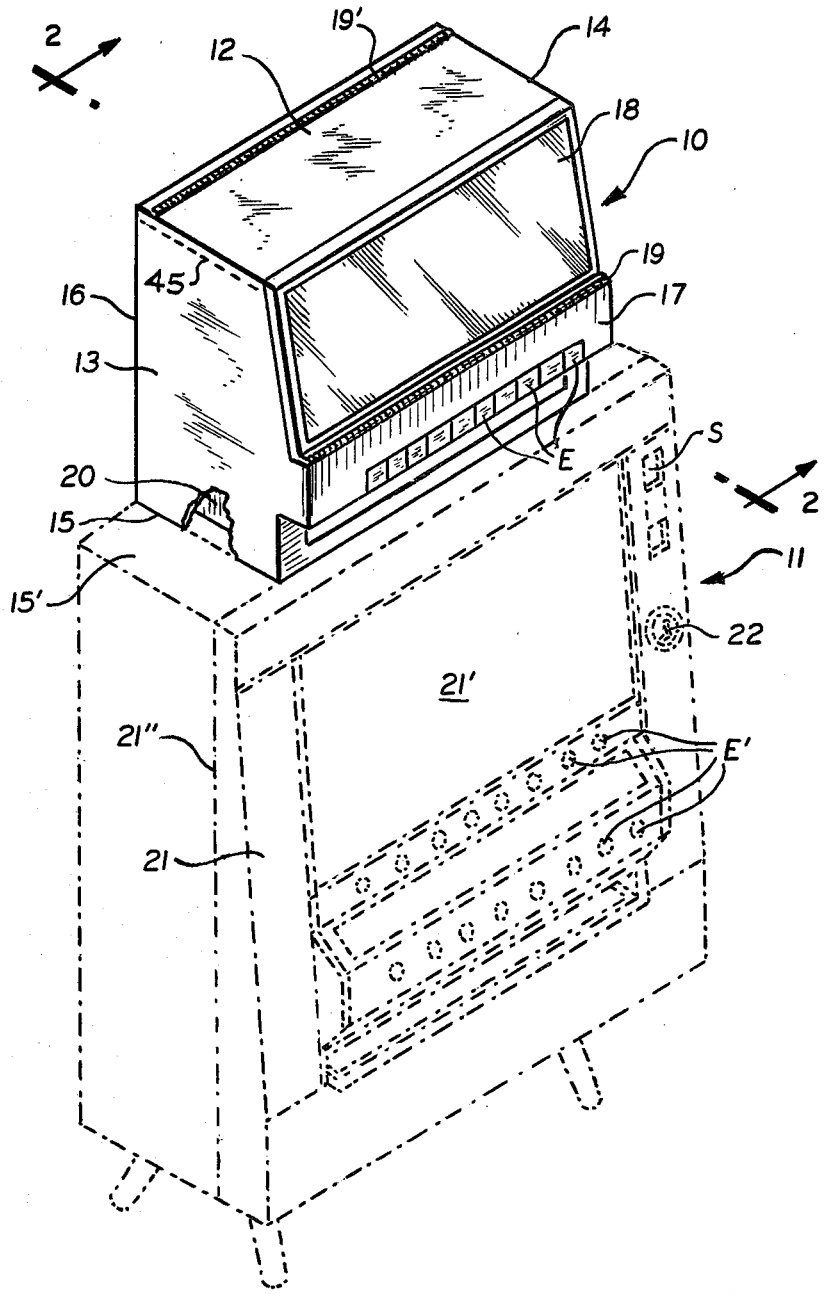
FIG. 1 is a perspective view of a satellite vending machine attached to a basic vending machine.

Referring to the drawings, the numeral 10 in FIG. 1 indicates a satellite vending unit that is mounted on and secured to the top of another basic vending unit 11. The satellite unit may operatively be connected to unit 11 for operation under control of a coin mechanism in unit 11 for locking out ejectors E′ of that unit on operation of an ejector E in unit 10 and conversely for locking out unit 10 on operation of an ejector in unit 11, all as disclosed in our mentioned application.

The unit 10 has a cabinet which is provided with an openable top lid 12, left and right side walls 13 and 14 (left and right being viewed from the front of the cabinet) and a bottom wall 15 which sits and is supported on the top wall 15′ of the underlying unit 11, as shown in FIG. 1. The cabinet also includes a rear wall 16 and a front wall 17 with a viewing window 18 to enable viewing of the items, or goods, within the cabinet unit 10. The front wall of the cabinet is advantageously hinged at 19 just below the viewing window (see also FIG. 2) and the top lid is also hinged at 19′ to provide access to the interior of the cabinet. The left side of a frame 20 within unit 10 is also shown in FIG. 1. The frame also has a rear and bottom wall, not shown, and a right side 27 shown in FIG. 2.

The bottom unit 11 for purpose of this disclosure has a front door 21 with a viewing window 21′ to permit viewing of the goods within unit 11. The door 21 is hinged at 21″ to permit opening and closing of the door about the hinge pivot. The door 21 may be opened or locked by means of a key in a keyway 22.

Figure 2:
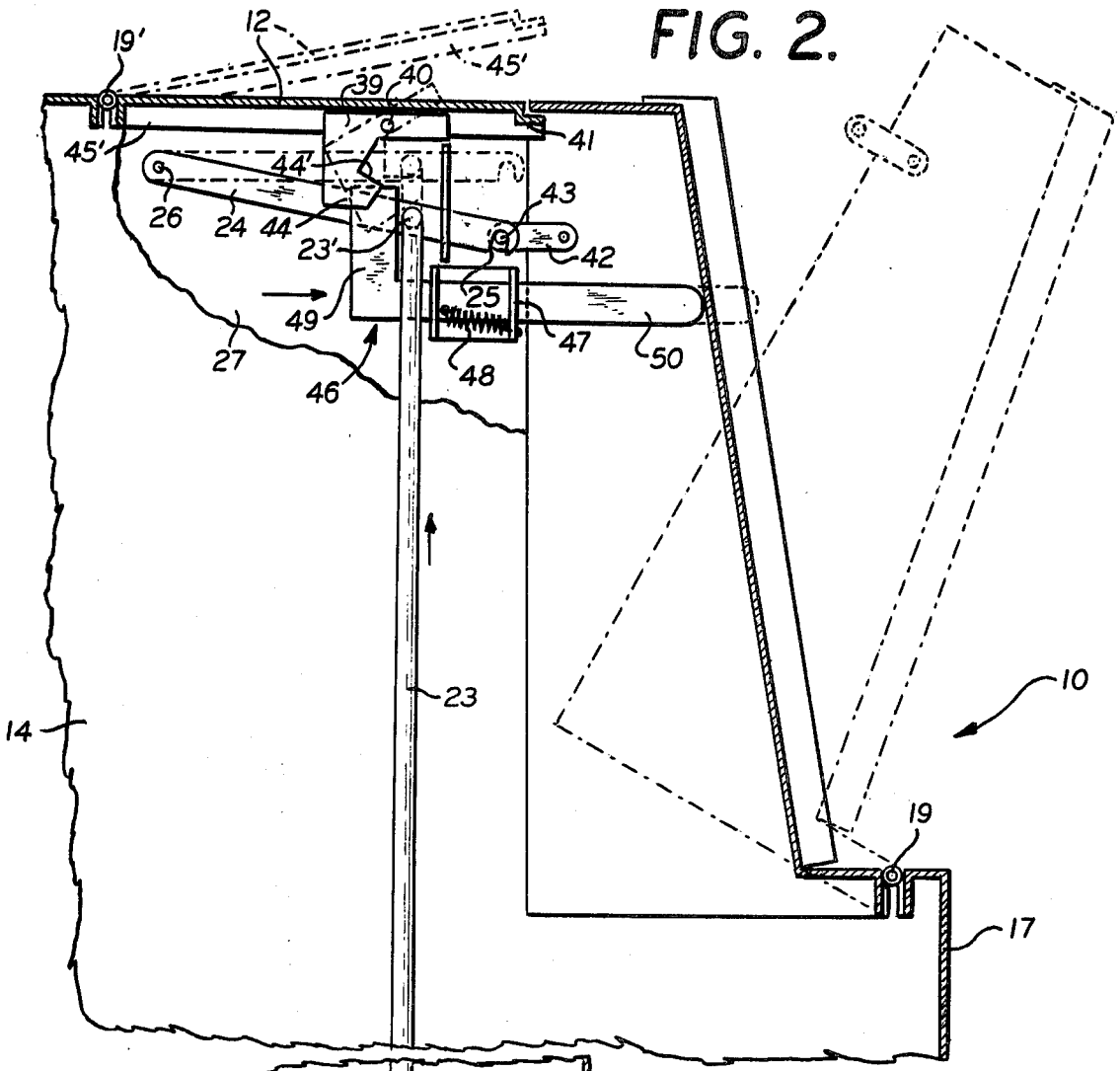
FIG. 2 is a partial sectional right side view of a locking arrangement taken through lines 2—2 of FIG. 1.
Figure 3:
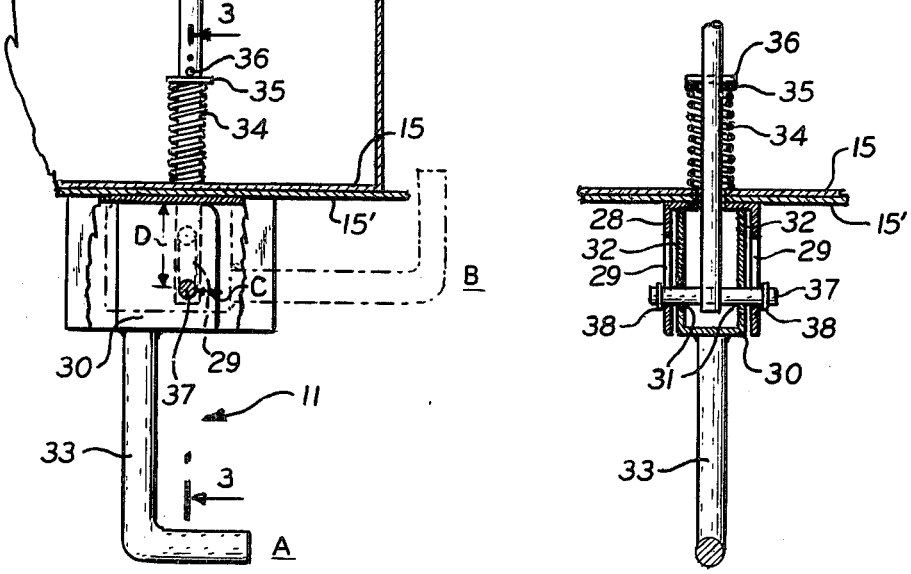
FIG. 3 is a longitudinal section taken through lines 3—3 of FIG. 2.

Referring to FIGS. 2 and 3, these Figures show our novel locking mechanism so constructed that the satellite unit access parts (door, lid etc.) must first be closed in order to enable closing and locking of the access parts of the basic unit. By virtue of the arrangement now be described, it is impossible for personnel to overlook locking of the satellite unit access parts after loading the magazine thereof with saleable items because, as noted, unless the satellite unit is first closed, it will not be possible to close and lock the access parts of the basic unit. To this end, and in the environment in which the interlock is disclosed for use, we provide a vertically reciprocable elongated rod 23 the upper end of which terminates in a transversely extending portion 23' of predetermined extent, fixed to arm 24 adjacent to an end thereof formed with a hook 25. The opposite end of arm 24 is mounted for pivotal movement about pin 26 fixed to the right side 27 of the frame.

As shown in FIGS. 2 and 3, the lower end portion of rod 23 extends through the satellite unit bottom wall 15 and the basic unit top wall 15'. A cam housing which may be in the form of an inverted U-shaped member 28 is suitably fixed to the inner face of the upper wall of the basic unit and is provided with vertical slots 29 in each of its downwardly extending legs. Positioned and supported within the housing is a cam element 30 having a shape complementary to that of the housing. The cam element is formed with circular openings 31 in its upwardly extending legs 32. An L-shaped handle 33 is integrally formed with and extends from the cam element outwardly of the housing 28 for manual operation thereof between positions A and B.

To effect movememt of the rod 23 upwardly and downwardly as the handle 33 is moved between positions A and B and vice-versa, a compression spring 34 is provided about the rod between the bottom wall 15 of the satellite unit and a retaining ring 35 whose upward movement is limited by cross pin 36 fixed to the rod. The cross pin is of a diameter and a metal which ensures its withstanding, without bending, the upward forces exerted thereon by spring 34 and ring 35. The lower end portion of the rod extends through the satellite bottom and basic unit top walls between the cam legs. The rod carries a transverse pin 37 which extends through the slots 29 and openings 31 in the housing and cam element legs respectively. Lock washers 38 are provided on the ends of the protruding transverse pin 37 to prevent lateral movement thereof. It will be appreciated from the structural arrangement thus far described, the spring 34, through the intermediary of retaining ring 35 and cross pin 36, exerts on the rod an upward force, which force is transmitted by transverse pin 37 to the cam element 30 which is otherwise free to rotate about pin 37 and is urged by spring 34 into engagement with the underside of the cam housing 28. Because of the location of pin 37 closer to the right hand end of cam element than to the upper end of the cam element, as viewed in FIG. 2, as shown at C and D respectively, the rod 23 moves upwardly under the influence of spring 34 when the handle 33 is moved from position A to position B and moves downwardly against the bias of spring 34 when the handle is moved from position B to position A. As the rod is thus moved, transverse pin 37 carried thereby is correspondingly moved in slot 29 in the cam housing.

An L-shaped member 39 is mounted for pivotal movement about a pin 40 fixed to the frame. The top lid 12 when closed about its pivot 19' maintains the member 39 in its solid line position and out of reach of the transverse portion 23' of the rod so that the latter may be moved up and down, as heretofore described, upon moving the handle 33 between positions A and B and vice-versa.

As will be seen in FIG. 2 when the hinged front door of the satellite unit is closed (shown in solid line position) the rear upper end of the door overlies a lip formation 41 at the forward end of the top lid preventing thereby raising of the top lid until the front door of the satellite unit is first opened. Accordingly, the top lid can only be raised after opening the front door of the satellite unit which, as will now be described, may be opened only when handle 33 is in its B position.

Fixed to the right side wall of the satellite cabinet is a member 42 having a projecting stud 43 positioned for engagement by the hook 25 when the arm 24 is moved from its phantom (position B of handle) to its solid line position (position A of handle). Accordingly, in order to gain access to the interior of the satellite unit after its front door has been locked, it is necessary to free the stud 43 from engagement with the hook of arm 24. If the basic unit front door is in locked condition one must first unlock that door, reach for the handle 33 inside the unit and then operate the handle by moving it from its A position to its B position in the course of which the rod and arm 24 are urged upwardly from their solid to their phantom line position disengaging the hook of arm 24 from the stud 43 so that the front door of the satellite unit may be opened to its phantom line position whereafter the top lid may be opened, by pivoting about 19', to its phantom line position.

As previously mentioned, when the top lid 12 is in its solid line closed position, it maintains the L-shaped member 39 in its solid line position in which it is out of reach of the transverse portion 23' of rod 23 so that the rod can freely be moved up and down by operating handle 33 as previously described. On the other hand, if the top is opened to its phantom line position, its restraining effect on the hook member 39 is removed. and the latter, due to the mass concentration in its horizontal leg portion, rotates counterclockwise about pivot pin 40 so that, with handle 33 in its B position, in which the rod 23 and arm 24 are in their phantom line position, part 44 of the horizontal leg portion of the hook member 39 underlies the transverse portion 23' of rod 23 as shown in phantom line in FIG. 2, blocking downward movement of the rod 23 and thereby preventing movement of the handle 33 from its B position to its A position unit the top lid is again closed incident to which the hook member is rotated clockwise to remove the horizontal leg portion thereof from blocking engagement with the rod 23. To enhance such blocking and unblocking action of the hook member, the horizontal leg portion is contoured at its upper surface as shown at 44'.

Handle 33 has a length to ensure, when in its B position, in which it is substantially perpendicular to rod 23, extension thereof from the basic unit to prevent closing and locking of the front door of the basic unit until the handle is moved to position A in which it is substantially parallel to rod 23 and wholly confined within the basic unit.

Assuming top lid 12 has been closed so that hook member 39 is out of reach of the rod transverse portion 23', handle 33 may then be moved from its B to its A position in which as noted it is wholly confined within the basic unit. when the handle is moved to its A position (with the front door of the satellite unit in its closed position) arm 24 is moved to its solid line position in which the slot therein overlies stud 43, locking thereby the front door and in turn the top lid. With handle 33 in its A position the front door of the basic unit may be closed and then locked to prevent access to handle 33 thereby preventing opening of the front door and the top lid of the satellite unit until the front door of the basic unit is again opened.

Means are provided which prevent the handle 33 from being moved from its B to its A position (thus preventing closure of the front door of the basic unit) should the lip 41 overlie the rear upper end of the satellite front door 17 as would occur if the front door of the satellite unit were closed before closure of the top lid 12. Such means advantageously comprise depending flanges at the opposite sides of the top lid, the left side flange being shown in phantom in FIG. 1 at 45 and the right side flange at 45' in FIG. 2. The bottom of the flanges when the lid is fully closed normally engage ledges (not shown) on the side walls of the satellite unit 10. Should the top lid however be lowered after instead of, as intended, before closure of the front door of the satellite unit, the flange bottom will engage the upper rear end surface portion of the satellite front door to maintain the lid sufficiently ajar to enable the hook member 39 to pivot about pin 40 to its underlying position relative to the transverse portion 23'. As previously described, when the hook member 39 underlies the transverse portion 23', the handle 33 cannot be moved from its B position to its A position, preventing thereby closure of the front door of the basic unit.

Further means may be provided to prevent movement of the handle 33 from its B position to its A position unless the front door of the satellite unit is closed. In the illustrated embodiment such means comprises a second L-shaped movable member 46, a U-shaped guide element 47 fixed to the right side wall of the satellite unit for guiding movement of member 46 and a spring 48 connected to the guide element and the movable member 46 for normally urging the movable member rightward, as viewed in FIG. 2. More specifically, the second L-shaped member 46 has a short leg 49 and a long leg 50, the latter passing through aligned guide slots (not shown) in the upstanding legs of the U-shaped guide element. The length of the L-shaped member 46 is such that when the front door of the satellite unit is closed the door will bear against the long leg 50 with sufficient force to urge it leftward within the alignment slots in the guide element, against the action of spring 48, a distance adequate to move the short leg 49 out of the path of movement of the transverse portion 23' of the elongated rod 23 thereby to permit, in the closed position of the satellite front door, movement of the handle 33 from its B position to its A position in which position the front door of the basic unit may in turn be closed.

When the front door of the satellite unit is in its open position, the L-shaped member is free to move to the right, under action of the spring 48, a distance sufficient for the upper end of the short leg 49 of the L-shaped member to underlie the transverse portion 23' when the latter is in its phantom line position shown in FIG. 2 (position B of handle 33) to which it must be moved to permit opening of the front door of the satellite unit, as previously described. With the short leg underlying the transverse portion 23', the handle 33 cannot be moved from its B position to its A position. Therefore the front door of the basic unit cannot be closed so long as the front door of the satellite unit remains open. Only when the satellite unit front door is again closed to urge the L-shaped member 46 leftward, against the bias of spring 48 can the handle 33 be moved from its B to its A position. With the handle 33 in its A position the front door of the basic unit may then be closed and locked.

When the top lid 12 and the front door of the satellite unit are open the contoured surface 44' of hook member 39 and the upper end of the short leg 49 are both positioned in blocking relation to the transverse portion 23' with the handle 33 in its B position. Only after first closing the top lid 12 and then the front door of the satellite unit can the handle 33 be moved from its B position to its A position as heretofore described.

It will be seen from the foregoing that the various objectives of the invention have been achieved. Since various changes can be made in the disclosed construction without departing from the scope of the invention, it is intended that what has been disclosed be viewed as illustrative and that the scope of the invention be determined by the appendant claims.

What we claim is:

1. A mechanism for use with first and second separate units each having a movable part movable between open and closed positions to respectively permit and prevent access to the interior of the units, said mechanism comprising elongate means supported at one of its ends in one of the units for movement between first and second positions and having an opposite end portion extending into the other unit, means in said other unit operatively connected to said opposite end portion of the elongate means for moving the latter between its first and second positions, said moving means including a manually operated element positioned wholly within the confines of the other unit upon moving the elongate means to one of its positions and extending exteriorly of said other unit upon moving the elongate means to its other position, said element, in one of its positions, preventing movement ot the movable part of the other unit to its closed position until said elongate means is moved to its said one position thereof in which it is adapted to hold the movable part of said one of said units in locked position.

2. The mechanism of claim 1, wherein said manually operated element in said one of its positions extends exteriorly to the other unit.

3. The mechanism of claim 1, in which the movable part of the first and second units is a door and in which said one end of the elongate means is operatively connected to a pivotally mounted arm for moving the latter between positions corresponding to the positions of said elongate means, and cooperating means on said arm and said door of said one of said units for maintaining the door in locked position when said elongate means is in said one position thereof.

4. A mechanism according to claim 3, characterized by means for preventing movement of the elongate means to said one of its positions when the door of said one unit is open.

5. A mechanism according to claim 4, wherein said movement preventing means comprises a movable member proximate to said elongate member, a fixed guide element for supporting and guiding movement of said movable member, and means connected between said guide element and movable member for normally urging the movable member in a direction to block movement of said elongate member to said one position thereof when the door of said one unit is open.

6. A mechanism according to claim 1, wherein said one of the units has a top lid movable between an open and a closed position, and means mounted proximate said lid and said one end of the elongate means for movement between first and second positions as a function of lid position, said last-named means preventing in one of its positions movement of the elongate means from its other position to said one position thereof and permitting in the other of its positions movement of the elongate means to said one position thereof.

7. A mechanism according to claim 6, wherein said movable part of said one unit comprises a front door which normally overlies a portion of the top lid, and means forming part of the top lid and being effective to hold it open should the front door underlie rather than overlie the top lid, said means mounted proximate said lid, in the open position of the lid, being in said one of its positions.

8. A mechanism according to claim 7, wherein said means forming part of the top lid comprise a pair of depending flanges, one at each side of the top lid.

9. The mechanism of claim 1, wherein said one of the units is disposed atop the other of said units, said elongate means comprising a length of rod extending from within said one of the units through the bottom wall thereof, with its opposite end portion extending through the top wall of the other unit, said moving means in said other unit constituting cam means comprising a cam housing fixed to the underside of the top wall of the other unit and a cam element within the housing operatively connected to said opposite end portion of the rod and an L-shaped handle element forming an extension of said cam element for moving the latter and thereby said rod between said one and said other position thereof, and spring means operatively related to said rod for urging the latter to said other position thereof.

10. The mechanism of claim 9, wherein said spring means surrounds the rod over a portion thereof delimited by the bottom wall of said one unit and means on the rod restricting extension of the spring means.

11. In combination with first and second vending machines wherein the first vending machine is mounted on top of the second vending machine and has a movable top lid having a lip formation and a movable front door having a part overlying the lip formation, means in said first machine for locking said lid and door only when said lid and door are in closed position, said means including an elongate element extending from said first machine into said second machine for operation of said means in the first machine from within said second machine.

12. The combination of claim 11, wherein said elongate element comprises a movable elongated rod extending from within the second machine into the first machine and being movable from within said second machine between a locking and an unlocking position in the first machine, said rod for this purpose being attached in said first machine to a pivotally mounted arm having formed thereon first means which in the locking position of the rod cooperates with second means on the first machine front door when in its closed position to lock the same.

13. The combination of claim 11, wherein said first machine dispenses store items under control of coin deposit in the second machine.

14. A locking arrangement for a satellite vending machine having a movable front door, which satellite machine overlies a basic vending machine and comprising means pivotally mounted at one end to the frame of the satellite machine for locking and unlocking the front door and including an elongate member extending downwardly through the upper wall of the underlying vending machine into the latter, pin means fixed to the downwardly extending member adjacent the downwardly extending end thereof, within said basic machine, and projecting laterally from said member, a cam element within said basic machine formed with openings for receiving therethrough said pin means, housing means within said basic machine for said cam element fixed to the inner surface of said upper wall of the basic machine for housing said cam element and having vertical slots through which said pin means also project, means on the projecting ends of said pin means for inhibiting lateral movement thereof, handle means forming an integral extension of said cam element for moving the latter between first and second positions in the course of movement of which said pin means is adapted to move upwardly and downwardly in said vertical slot thereby moving said first-named means between its locking and unlocking positions, and means on the movable front door of the satellite machine for cooperating with said first-named means for locking said front door on movement of said first-named means to its locking position.

15. The locking arrangement according to claim 14, wherein said first-named means comprises a pivotally connected arm to which the elongate member is connected for vertical displacement, spring means being provided in surrounding relation to said elongate member over that portion thereof extending above a lower wall of the overlying machine to an abutment means on the elongate member upwardly spaced from said lower wall.

16. The locking arrangement according to claim 15, wherein the handle means is L-shaped and in its said first position extends outwardly of the basic machine preventing closure of its door.

17. A mechanism for use with first and second separate units each having a movable part movable between open and closed positions to respectively permit and prevent access to the interior of the units, said mechanism comprising elongate means supported at one of its ends in one of the units for movement between first and second positions and having an opposite end portion extending into the other unit, means in said other unit operatively connected to said opposite end portion of the elongate means for moving the latter between its first and second positions and including a manually operated element which in one position of said elongate means is generally parallel thereto and which in the other position of the elongate means is generally perpendicular thereto, said element in the other position of the elongate means preventing movement of the movable part of the other unit to its closed position until said elongate means is moved to its said one position thereof.

18. In combination with first and second vending machines wherein the first vending machine is mounted on top of the second vending machine and has a movable top lid having a lip formation and a movable front door having a part overlying the lip formation, means operative to lock said lid and door from within said second vending machine only when said lid and door are in their fully closed position, said means including a movable elongate rod extending from within the second machine between a locking and an unlocking position in the first machine, said rod for this purpose being attached in said first machine to a pivotally mounted arm having formed thereon first means which in the locking position of the rod cooperates with second means on the first machine front door when in its closed position to lock the same.

* * * * *